United States Patent [19]

Werner

[11] Patent Number: 4,830,144

[45] Date of Patent: May 16, 1989

[54] SCAFFOLD

[75] Inventor: Richard H. Werner, Atlanta, Ga.

[73] Assignee: Saf-T-Green Manufacturing Corporation, Atlanta, Ga.

[21] Appl. No.: 232,521

[22] Filed: Aug. 15, 1988

Related U.S. Application Data

[63] Continuation of Ser. No. 148,082, Jan. 25, 1988, abandoned, and a continuation-in-part of Ser. No. 61,400, Jun. 15, 1987.

[51] Int. Cl.[4] ..... E04G 1/20

[52] U.S. Cl. ..... 182/178; 182/119; 182/179

[58] Field of Search ..... 182/178, 179, 118, 119; 52/637, 638

[56] References Cited

U.S. PATENT DOCUMENTS

| | | | |
|---|---|---|---|
| D. 142,350 | 8/1945 | Reiner . | |
| 2,203,113 | 6/1940 | Uecker | 182/178 |
| 2,506,640 | 5/1950 | Hawes . | |
| 2,555,782 | 6/1951 | Brownstein | 182/178 |
| 2,619,390 | 11/1952 | Johnson | 182/119 |
| 2,818,308 | 12/1957 | Williams . | |
| 3,023,833 | 3/1962 | Hunnebeck | 182/179 |
| 3,071,206 | 1/1963 | Kristen | 182/119 |
| 3,084,761 | 4/1963 | Robertson . | |
| 3,190,405 | 6/1965 | Squire | 182/178 |
| 3,305,046 | 2/1967 | Schar | 182/179 |
| 3,313,081 | 4/1967 | Squire | 182/178 |
| 3,454,131 | 7/1969 | Johnson | 182/178 |
| 3,565,212 | 2/1971 | Johnson | 182/179 |
| 4,262,774 | 4/1981 | Chez . | |
| 4,291,784 | 9/1981 | Moses . | |
| 4,462,197 | 7/1984 | D'Alessio | 182/178 |
| 4,597,472 | 6/1986 | Hjelm . | |

*Primary Examiner*—Reinaldo P. Machado
*Attorney, Agent, or Firm*—Kilpatrick & Cody

[57] ABSTRACT

Scaffolding that has a high strength-to-weight ratio, and is light, well balanced and easy to carry, lift, and assemble. The decking cross member of scaffold frames according to the invention is placed at approximately forty percent (40%) of the height of the scaffold frame. Other structural members laterally connect the frame uprights to add strength and to balance the frame about the midportions of the uprights. This structure allows for quick and easy scaffolding assembly with a minimum of danger. A worker standing on the decking of a level of scaffolding can easily reach the top of the frame supporting the decking on which he is standing, which is approximately waist high, in order to assemble the next level of scaffolding. Location of the decking cross member also places the decking at approximately the same height as the cross bracing between frames, so that workers standing on the decking can work on adjacent vertical surfaces with minimum impairment of arm movement by cross braces.

9 Claims, 3 Drawing Sheets

SCAFFOLD

This is a continuation of a co-pending application for a Scaffold, U.S. Ser. No. 148,082, filed on Jan. 25, 1988, now abandoned, and a continuation-in-part of a co-pending application for a Scaffolding Frame, U.S. Ser. No. 061,400, filed on June 15, 1987.

The present invention relates to scaffolds. Scaffold frames of the present invention are designed and constructed for balance about their midportions so they can be transported and assembled easily, quickly and safely. Decking support members connect the frames' midportions rather than their tops as in conventional frames, in order to lend balance to the frames, to allow workers easily to reach the top of the frames supporting the decking on which they are standing and to place the decking at approximately the same level as the cross bracing so that the cross bracing does not obstruct workers standing on the decking from working on a vertical surface adjacent to the scaffolding. Workers can thus easily assemble the next level of scaffolding from the present level, and they can easily work on adjacent vertical surfaces without cross-braces impairing their arm movements. Gravity-operated guard rail studs are preferably mounted on the frames' uprights to ease assembly of the scaffolding and to reduce the possibility of improper connections between structural members of the scaffolding.

BACKGROUND OF THE INVENTION

Increases in labor costs, heightened safety concerns and recently imposed regulations create new requirements for those in the construction industry who use scaffolding. A single type of scaffolding may once have been appropriate for exterior and interior construction activities and for single or multilevel and higher buildings, but contractors have now begun to prefer more specialized scaffolding for various applications. They thus prefer lighter-weight scaffolding for uses such as in interiors and shorter buildings. Scaffolding which can be quickly, easily and safely carried, lifted and assembled now almost universally meets with greater approval than more cumbersome scaffolding.

SUMMARY OF THE INVENTION

The present invention provides scaffolding which has a high strength-to-weight ratio and is easily and safely carried, lifted and assembled with a minimum of danger to workers. The invention features scaffolding frames whose decking support cross members are preferably located at approximately 40% of their length. This position of the cross member balances the frame and places great lateral strength in the midportion of the frame to eliminate the need for great lateral strength (and weight) at the top and bottom of the frame. The positioning of the decking cross member also eases assembly of the scaffolding because it requires workers to lift the next level of scaffolding only approximately waist-high in order to connect it to the top of the scaffolding presently supporting them. The decking cross member position between guard rail studs that support cross bracing between frames ensures that those standing on the decking can work on adjacent vertical surfaces without cross braces impairing their arm movement.

Guard rail studs of a gravity-operated quick-lock type are preferably mounted to the scaffold frame uprights to ease assembly of scaffolding even further. Studs conventionally known as safe-lock, or other types of studs may also be used. These studs support cross bracing and guard rails. The gravity-operated nature of these studs allows workers to place and disconnect cross bracing and guard rails with a minimum of potential for inadvertent disconnection or structural failure.

It is therefore an object of the present invention to provide scaffolding that is balanced, strong, lightweight and easy to transport and assemble.

It is an additional object of the present invention to provide scaffolding whose decking is connected to the frames at approximately the height of the cross bracing, so that workers standing on the decking may work on adjacent vertical surfaces with minimum impairment of arm movement by cross bracing.

It is an additional object of the present invention to provide scaffolding that can be carried, lifted and assembled in a minimum of time and with a minimum of danger, thereby reducing labor costs.

It is an additional object of the present invention to provide scaffolding which requires a minimum of materials and expense to manufacture and has a high strength-to-weight ratio.

It is an additional object of the present invention to eliminate the need for guard rail posts which would ordinarily support guard rails on the top level of scaffolding.

Other objects, features and advantages of the invention will become apparent with reference to the remainder of this document.

DETAILED DESCRIPTION OF THE DRAWINGS

Figure 1:
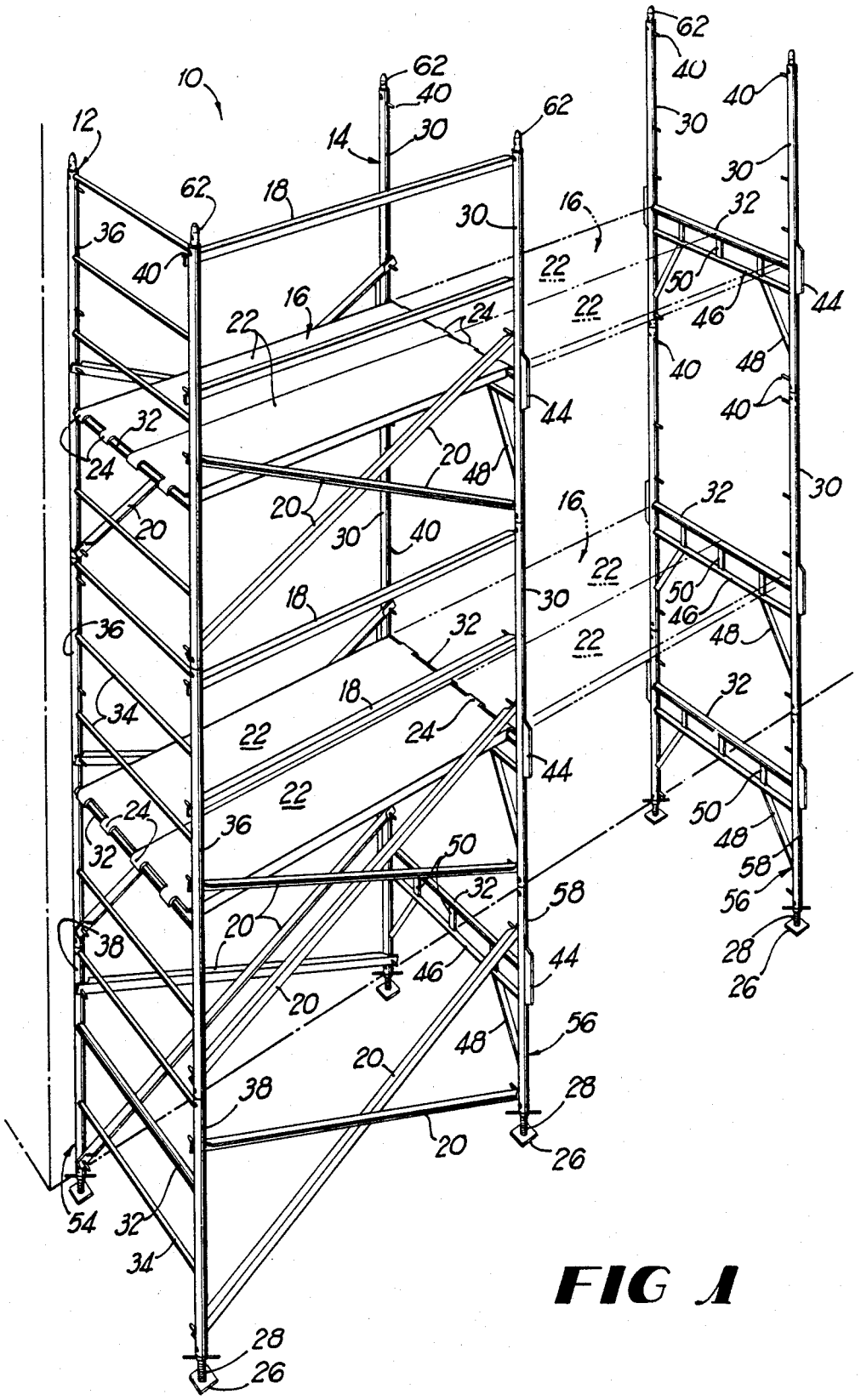
FIG. 1 is a perspective view of scaffolding according to the present invention showing the use of both end frames and walk-through frames.

Scaffolding 10 according to the present invention is shown in FIG. 1 in perspective. Scaffolding 10 generally comprises end frames 12, walk-through frames 14, decking 16, guard rails 18 and cross braces 20 connecting the frames 12 and 14.

As shown in FIG. 1, scaffolding 10 is preferably of width sufficient for two widths of decking 16. Such decking is preferably in the form of metallic lightweight plates 22. These plates preferably have conventional claws at both ends to capture guard rail cross members on frames 12 and 14. Wooden decking plates 22 or plates 22 of other desirable construction and materials may also be used.

Guard rails 18 and cross braces 20 are of conventional construction and design. They are typically and preferably formed of angle iron or tubes, but they may be formed of other desirable material. Cross braces 20 diagonally span adjacent frames and create trusses to add stability to scaffolding 10. Guard rails 18 may span frames as desired as a safety measure for those working on the scaffolding 10.

FIG. 1 shows the advantageous placement of decking 16 with respect to cross braces 20 of the present invention. Decking 16 is connected to frames 12 and 14 of the scaffolding at approximately the same height as the cross bracing 20, and preferably as the upper portions of cross bracing 20, so that workers standing on the decking 16 can work on adjacent vertical surfaces without cross bracing 20 interfering with their arm movement. Typical scaffolding, in which the decking is connected near the tops of the frames, place the cross braces approximately waist high to workers standing on the scaffold decking. Workers thus tend to remove cross bracing in conventional scaffolds when they work on adjacent vertical surfaces. This decreases the structural rigidity and strength of the scaffold, and allows workers more easily to fall from the scaffold. Applicant's invention reduces or eliminates these problems.

Scaffolding 10 may include foot plates 26 and leveling screws 28 inserted into the bottom of end frames 12 and walk-through frames 14. The foot plates distribute the load imparted on the supporting surface by scaffolding 10 over a greater surface area than that simply comprising the cross sectional area of scaffolding 10 tubing. Leveling screws 28 may be used to adjust the height and tilt of scaffolding 10 as desired for uneven surfaces and for additional stability. Foot plates 26 and leveling screws 28 are conventional.

Figure 2:
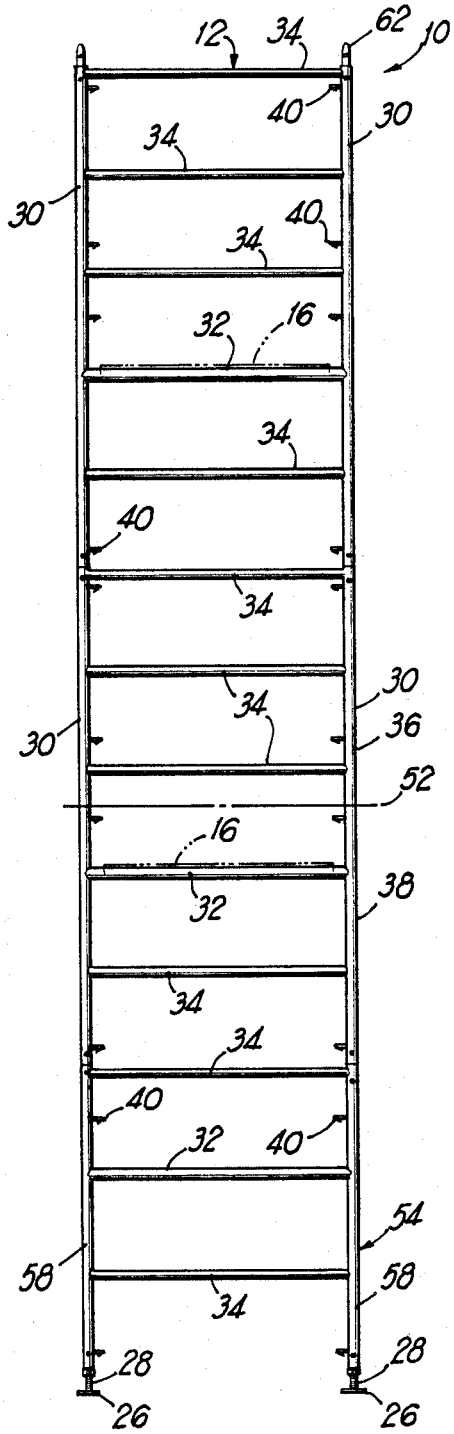
FIG. 2 is an elevational view of end framing according to the present invention.
Figure 3:
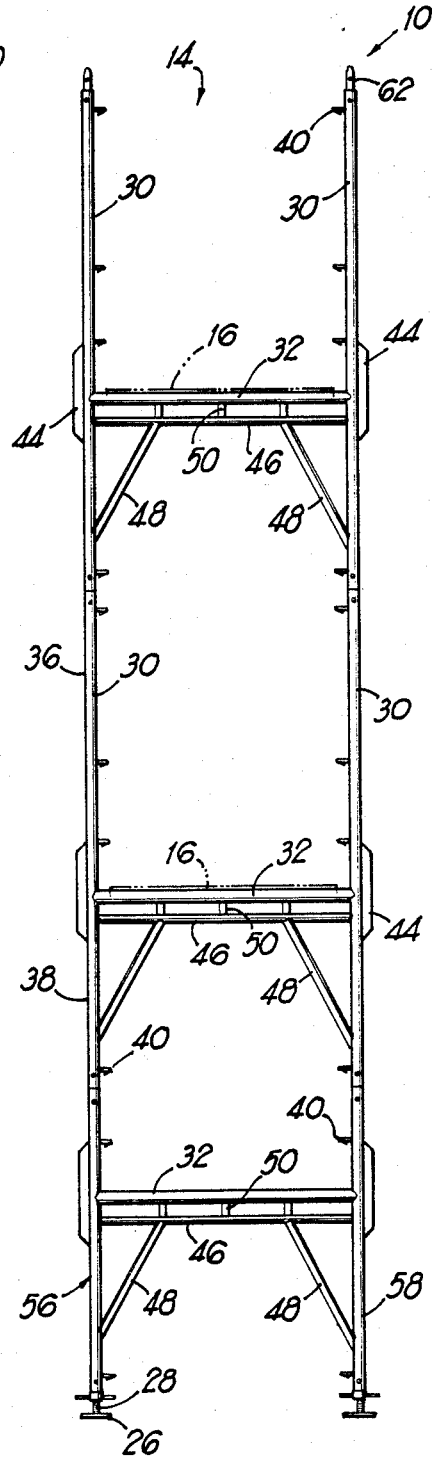
FIG. 3 is an elevational view of walk-through framing according to the present invention.

FIG. 2 shows end frames 12 according to the present invention in elevation while FIG. 3 shows walk-through frames 14 in elevation. End frames 12 are formed of a pair of uprights 30 spanned by other structural members. A decking cross member 32 is welded or otherwise connected substantially perpendicular to uprights 30 to connect them. End guard rails 34 are also welded or otherwise connected substantially perpendicular to uprights 30 to create a ladder-like structure.

Uprights 30, decking cross member 32 and end guard rails 34 are preferably formed of steel or other metallic tubing and welded together. Cross member 32 is preferably of diameter greater than end guard rails 34 because it must support decking 16 and thus persons and materials supported by decking 16.

Cross member 32 preferably connects uprights 30 at approximately forty percent (40%) of their length to create longer upright portions 36 and shorter upright portions 38. Cross member 32 can, for instance, be located at between thirty and fifty percent (30%–50%) of the length of uprights 30. In the preferred embodiment shown in FIG. 2, the bottom of uprights 30 (as depicted in FIG. 2) is the reference for placement of the cross member 32; the top of uprights can also serve as the reference, however, so that the cross member 32 would be located at approximately sixty percent (60%) of upright 30 length, or between fifty and seventy percent (50%–(70%) of upright 30 length using upright 30 bottoms as a reference. One end guard rail 34 spans the shorter upright portions 38 in the preferred embodiment, while three span the longer upright portions 36.

Guard rail studs 40, preferably with gravity-operated latches 42 or other conventional latches, are welded or otherwise mounted on end frames 12 at places where guard rails 18 and cross braces 20 will be connected.

Walk-through frames 14 as shown in FIG. 3 are formed of uprights 30, decking cross member 32, and guard rail studs 40 as described above with reference to end frames 12. Flanges 44 are also welded or otherwise mounted on the exterior of uprights 30 of walk-through frame 14 opposite to where decking cross members 32 are connected. Walk-through frames 14 contain no end guard rails 34, however. Instead, they contain structure for supporting decking cross member 32 and for stabilizing uprights 30 with respect to decking cross member 32. Decking cross member 32 is located with respect to uprights 30 as described above for end frames 12. A lateral brace 46 spans shorter upright portions 38 of walk-through frames 14 in the vicinity of decking cross member 32. Spacing of lateral brace 46 may be adjusted to balance walk-through frames 14.

Diagonal braces 48 connect uprights 30 and lateral brace 46 to form triangular structures with those members in order to strengthen walk-through frame 14 by, among other things, minimizing or preventing rotation of uprights 30 about the points at which they are connected to decking cross member 32. Diagonal braces 48 also add mass to shorter upright portions 38 of walk-through frames 14 to balance the structure of walk-through frames 14. Lateral brace 46 is connected to decking cross member 32 by a plurality of stringers 50 which are preferably welded substantially perpendicularly to those members to span them. Lateral brace 46 is preferably made of tubing smaller in diameter than decking cross member 32 or uprights 30. Diagonal braces 48 are preferably made of angle iron. Stringers 50 are preferably made of flat bar or plate. These members may be made of other convenient materials and are welded together or otherwise connected.

End frames 12 and walk-through frames 14 according to the above-described construction are well balanced about their midpoints or midportions 52 for ease of handling and transportation. This can be easily visualized with reference to FIGS. 2 and 3. The decking cross member 32 in end frame 12 is of larger diameter than end guard rails 34 and is offset from the midlength of uprights 30 by approximately ten percent (10%). The three end guard rails 34 joining the longer upright portions 36 are located on the other side of the upright 30 midpoints 52 from decking cross member 30 and are counterbalanced by decking cross member 32 and the end guard rail 34 joining the shorter upright portions 38. The moment of inertia about the midpoint of uprights 30 created by decking cross member 32 and the end guard rail 34 located below it is thus approximately cancelled by the moment of inertia created by the other three end guard rails 34 above decking cross member 32.

As shown in FIG. 3, the decking cross member 32, lateral brace 46, diagonal braces 48 and stringers 50 are all located on one side of upright midpoint 52 in walk-through frames 14 to create a moment of inertia which is compensated for by the greater length and mass of longer upright portions 36 as compared to shorter upright portions 38. The effect once again is a well-balanced frame 14 which may be easily lifted, handled, transported and assembled.

Placement of decking cross members 32 at approximately forty percent (40%) of the length or height of uprights 30 also makes for scaffolding that is easy to assemble. A worker standing on decking 16 finds the top of the uprights 30 of the frame 12 or 14 supporting that decking to be approximately waist high or slightly higher. He can thus easily lift into place and connect the next level of end frames 12 and 14 and also reach guard rail studs 40 on the next level to connect cross braces 20 to the next level of structure. Yet walk-through frames 14 allow the same amount of height between successive levels of decking 16 as conventional scaffolding where decking cross members are located at or near the top of the frame.

Applicant's invention also includes base end frames 54 and base walk-through frames 56 in order to suspend the first level of decking 16 at a desirable height above ground or floor. These allow the decking 16 in the lowest level of scaffold 10 to be at the same height above ground as the next higher-up level of decking 16 is with respect to it. Base end frame 54 includes uprights 58 which are shorter in length than uprights 30 of end frames 12 and walk-through frames 14. These are connected in the preferred embodiment by a decking cross member 32 and end guard rails 34. Base end frame 54 contains guard rail studs 40, and latches 42 as described above with reference to end frames 12 and walk-through frames 14. Base end frame 54 may be visualized easily as the bottom portion of an end frame 12 in which the uprights 30 have been truncated immediately above the first end guard rail 34 away from decking cross member 32, to form a structure which is approximately equal in length to longer upright portions 36 of end frames 12 or walk-through frames 14.

The convenient spacing of decking cross members 32 and end guard rails 34 in end frames 12 and base end frames 54 also make it easy for workers to climb and thus to access scaffolding of the present invention.

Base walk-through frame 56 is also formed of truncated uprights 58 connected by a decking cross member 32 and a lateral brace 46 as described above with respect to walk-through frame 14. Diagonal braces 48 and stringers 50 complete the structure. Base walk-through frame 56 may be visualized as a walk-through frame 14 in which the uprights 58 have been truncated above cross member 32 to form a structure which is approximately equal in length to longer upright portion 36 of end frames 12 or walk-through frames 14.

Figure 4:
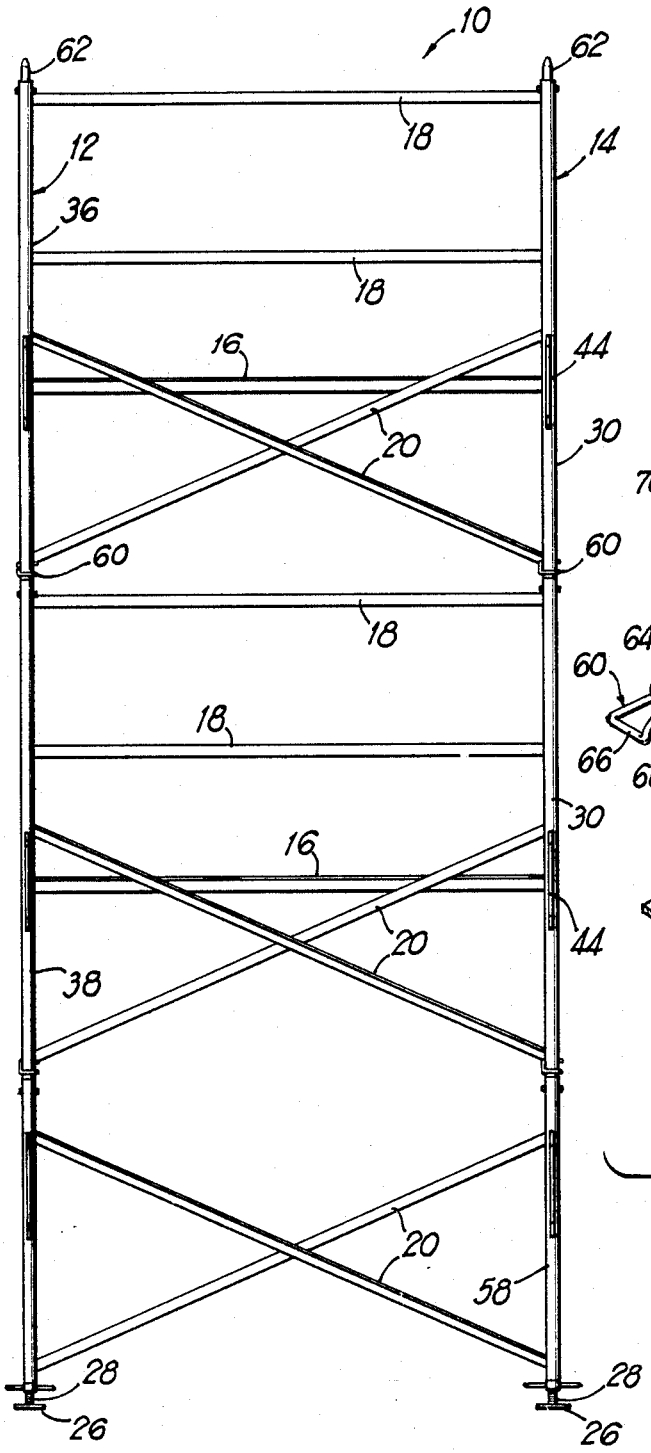
FIG. 4 is an elevational view of guard railing and cross bracing between adjacent frames of scaffolding according to the present invention.

FIG. 4 is a side elevational view of scaffolding 10 according to the present invention showing placement of guard rails 18 and cross braces 20. Location of these in the scaffolding is well known in the construction industry. FIG. 4 also shows once again how the advantageous placement of decking cross member 32 between cross bracing studs 40 allows workers to work on adjacent vertical surfaces without impairment of arm movement. Workers may easily snap guard rails 18 and cross braces 20 into place in scaffolding of the present invention to form secure connections by use of guard rail studs 40 and latches 42.

Figure 5:
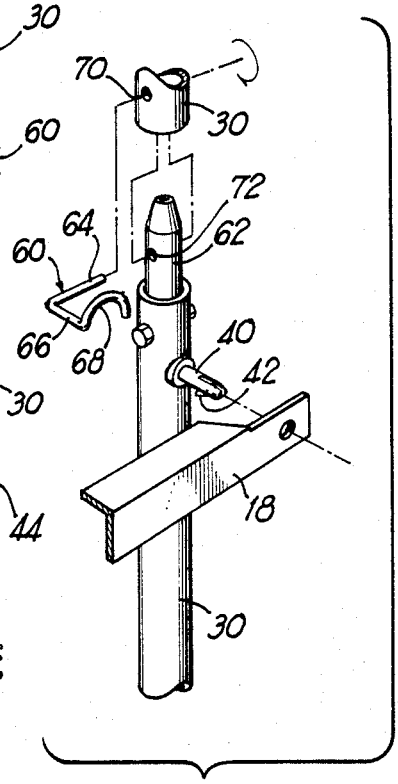
FIG. 5 is a view showing jointing and a quick-lock guard rail stud according to the present invention.

FIG. 5 is a closer view of a guard rail stud 40 and a latch 42 according to the present invention. It also shows a preferred form of key 60 for the bayonet pin 62 which may connect uprights 30 to one another. Key 60 is preferably formed of tubular-shaped metal and contains an insertion portion 64 which is of length sufficient to penetrate the diameter of an upright 30. Insertion portion 64 is connected at right angles to a shank 66 which is in turn connected at right angles to a semi-circular collar 68. The key 60 is used by inserting it into and penetrating openings 70 and 72 in upright 30 and pin 62 respectively. The shank 66 and semi-circular collar 68 are then allowed to fall so that collar 68 surrounds approximately one-half of upright 30 or the upright 30 below it to minimize the possibility that insertion portion 64 can slide out of openings 70 and 72. The elements that workers use to connect scaffolding parts of the present invention, the keys 60 and guard rail studs 40, are thus both gravity operated. This feature allows such scaffolding to be more quickly and easily assembled, and to be safer.

The foregoing is provided for purposes of illustration and explanation. Modifications and enhancements may be made to the embodiments described above and still fall within the scope and spirit of the invention.

I claim:

1. A scaffold frame comprising:
(a) a pair of uprights oriented substantially parallel to one another;
(b) a plurality of end guard rails connecting and oriented substantially perpendicular to the uprights;
(c) a plurality of guard rail studs mounted on the uprights;
(d) a decking cross member of circumference larger than the end guard rails connecting the uprights at approximately forty percent (40%) of the uprights' length and oriented substantially perpendicular to the uprights;
(e) the end guard rails and decking cross member placed such that the frame is balanced at substantially one-half the length of the uprights.

2. A scaffold frame according to claim 1 comprising four end guard rails, three connecting the uprights on a first side of the decking cross member and the fourth connecting the uprights on the other side of the cross member.

3. A scaffold frame according to claim 1 of width sufficient to accommodate two widths of decking planks.

4. A scaffold frame according to claim 1 in which each guard rail stud includes a gravity-operated latch.

5. A scaffold frame comprising:
(a) a pair of uprights oriented substantially parallel to one another;
(b) a decking cross member connecting the uprights at approximately forty percent (40%) of their length to divide each upright into a shorter and a longer portion, which cross member is oriented substantially perpendicular to the uprights;
(c) four end guard rails connecting and oriented substantially perpendicular to the uprights, three connecting the longer portions and the fourth connecting the shorter portions;
(d) the end guard rails and the decking cross member placed such that the frame balances at approximately one-half the length of the uprights; and
(e) a plurality of guard rail studs mounted on the uprights.

6. A walk-through scaffold frame, comprising:
(a) a pair of uprights oriented substantially parallel to one another;
(b) a decking cross member connecting the uprights at approximately forty percent (40%) of their length to divide each upright into a shorter and a longer portion, which cross member is oriented substantially perpendicular to the uprights;
(c) a lateral brace connecting the shorter portions of the uprights and oriented substantially perpendicular to the uprights;
(d) a pair of diagonal braces, each connected to an upright and the lateral brace to form a triangle;
(e) a plurality of stringers, each connecting the lateral brace and the decking cross member;
(f) the decking cross member, lateral brace, diagonal braces and stringers placed such that the frame balances at approximately one-half the length of the uprights; and (g) a plurality of guard rail studs mounted on the uprights.

7. A scaffold frame according to claim 6 in which each guard rail stud includes a gravity-operated latch.

8. A scaffold frame according to claim 6 further comprising a pair of flanges, each extending from an upright on the exterior of the upright opposite to where the upright connects to the decking cross member.

9. A scaffold comprising:

(a) at least one scaffold frame, comprising:

(i) a pair of uprights oriented substantially parallel to one another;

(ii) a plurality of end guard rails connecting and oriented substantially perpendicular to the uprights;

(iii) a plurality of guard rail studs mounted on the uprights;

(iv) a decking cross member of circumference larger than the end guard rails connecting the uprights at approximately forty percent (40%) of their length and oriented substantially perpendicular to the uprights;

(v) the end guard rails and decking cross member placed such that the frame is balanced at substantially one-half the length of the uprights;

(b) at least one walk-through scaffold frame, comprising:

(i) a pair of uprights oriented substantially parallel to one another;

(ii) a decking cross member connecting the uprights at approximately forty percent (40%) of their length to divide each upright into a shorter and a longer portion, which cross member is oriented substantially perpendicular to the uprights;

(iii) a lateral brace connecting the shorter portions of the uprights and oriented substantially perpendicular to the uprights;

(iv) a pair of diagonal braces, each connected to an upright and the lateral brace to form a triangle;

(v) a plurality of stringers, each connecting the lateral brace and the decking cross member;

(vi) the decking cross member, lateral brace, diagonal braces and stringers placed such that the frame balances at approximately one-half the length of the uprights; and (vii) a plurality of guard rail studs mounted on the uprights;

(c) a plurality of cross braces connected to guard rail studs of adjacent frames;

(d) a plurality of decking members spanning adjacent frames; and (e) a plurality of guard rails connected to guard rail studs of adjacent frames.

* * * * *